US009982900B2

(12) United States Patent
Hancock

(10) Patent No.: US 9,982,900 B2
(45) Date of Patent: May 29, 2018

(54) METHOD OF ATTACHING ELECTRODES TO PLATED THERMOSET PLASTIC HEATED BLOWER HOUSING

(71) Applicant: Trane International Inc., Piscataway, NJ (US)

(72) Inventor: Stephen Stewart Hancock, Flint, TX (US)

(73) Assignee: Trane International Inc., Piscataway, NJ (US)

( * ) Notice: Subject to any disclaimer, the term of this patent is extended or adjusted under 35 U.S.C. 154(b) by 452 days.

(21) Appl. No.: 14/577,623

(22) Filed: Dec. 19, 2014

(65) Prior Publication Data

US 2015/0211765 A1 Jul. 30, 2015

Related U.S. Application Data

(60) Provisional application No. 61/933,263, filed on Jan. 29, 2014.

(51) Int. Cl.

| | |
|---|---|
| ***F24H 3/02*** | (2006.01) |
| ***F24H 1/10*** | (2006.01) |
| ***F24F 1/56*** | (2011.01) |
| ***F24H 9/00*** | (2006.01) |
| ***F04D 29/02*** | (2006.01) |
| ***F04D 29/42*** | (2006.01) |
| ***F04D 29/58*** | (2006.01) |
| *F24F 13/20* | (2006.01) |

(52) U.S. Cl.

CPC ..... *F24F 1/56* (2013.01); *F04D 29/023* (2013.01); *F04D 29/4226* (2013.01); *F04D 29/584* (2013.01); *F24H 3/022* (2013.01); *F24H 9/0073* (2013.01); *F05D 2260/20* (2013.01); *F05D 2300/171* (2013.01); *F05D 2300/611* (2013.01); *F24F 2013/205* (2013.01); *F24F 2221/34* (2013.01)

(58) Field of Classification Search

None

See application file for complete search history.

(56) References Cited

U.S. PATENT DOCUMENTS

| | | | | |
|---|---|---|---|---|
| 2,628,299 A | | 2/1953 | Gaiser | |
| 2,882,377 A | | 4/1959 | Rinehart | |
| 3,683,361 A | | 8/1972 | Salzwedel | |
| 3,697,728 A | * | 10/1972 | Stirzenbecher | B64C 1/18 219/213 |

(Continued)

*Primary Examiner* — Thor Campbell

(74) *Attorney, Agent, or Firm* — Conley Rose, P.C.; J. Robert Brown, Jr.

(57) ABSTRACT

A blower assembly of an HVAC system may include an electrically-conductive plating applied to an inner surface of a blower housing, a first electrode attached to the electrically-conductive plating at an inner wall of the blower housing via an electrically-conductive RTV silicone, and a second electrode attached to the electrically-conductive plating at an outer wall of the blower housing via an electrically-conductive RTV silicone. The first electrode may pass a current through the electrically-conductive plating of the blower housing to the second electrode that may act as an ohmic heater and provide a thermal energy discharge which may exchange heat with an airflow flowing through the blower housing as a result of operating the blower assembly.

19 Claims, 5 Drawing Sheets

(56) References Cited

U.S. PATENT DOCUMENTS 3,931,496 A 1/1976 Hurko
4,173,823 A 11/1979 Anderson et al.
4,485,297 A 11/1984 Grise et al.
6,103,999 A 8/2000 Nishio et al.
6,762,396 B2 * 7/2004 Abbott ..... F27D 11/02 118/724
6,873,790 B1 * 3/2005 Cooper ..... F24H 3/0405 219/543
7,168,917 B2 * 1/2007 Bronaugh ..... F24H 3/0405 415/177
7,675,004 B2 3/2010 Nakajima et al.
8,155,508 B2 * 4/2012 Caine ..... A47K 10/48 34/267
8,428,445 B2 * 4/2013 Abbott ..... C23C 4/06 219/543
8,575,518 B2 * 11/2013 Walsh ..... F24H 3/002 219/217
9,188,361 B2 * 11/2015 Yuan ..... F04D 29/4226
9,194,603 B2 * 11/2015 Yuan ..... F04D 25/14
2002/0096512 A1 7/2002 Abbott et al.
2004/0149733 A1 * 8/2004 Abbott ..... B29C 33/02 219/535
2005/0111840 A1 * 5/2005 Craw ..... F24H 3/0411 392/350
2005/0123396 A1 * 6/2005 Bronaugh ..... F24H 3/0405 415/176
2008/0083740 A1 * 4/2008 Kaiserman ..... A43B 7/04 219/520
2008/0217324 A1 * 9/2008 Abbott ..... C23C 4/06 219/538
2010/0245030 A1 9/2010 Ikeda et al.
2011/0129203 A1 * 6/2011 Abbott ..... C23C 4/06 392/352
2013/0213953 A1 * 8/2013 Abbott ..... C23C 4/06 219/542
2013/0223823 A1 * 8/2013 Abbott ..... C23C 4/06 392/360
2013/0256299 A1 * 10/2013 Abbott ..... C23C 4/06 219/553

* cited by examiner

METHOD OF ATTACHING ELECTRODES TO PLATED THERMOSET PLASTIC HEATED BLOWER HOUSING

CROSS-REFERENCE TO RELATED APPLICATIONS

The present application claims priority under 35 U.S.C. 119(e) to U.S. Provisional Patent Application No. 61/933,263 filed on Jan. 29, 2014 by Stephen Stewart Hancock, entitled "Method of Attaching Electrodes to Plated Thermoset Plastic Heated Blower Housing," the disclosure of which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally comprise a blower assembly that may be selectively operated to deliver an airflow through an air handling unit (AHU) based on a demand for heating or cooling. In some applications, a blower assembly may be required to deliver a heated airflow to an air-conditioned space. In such applications, a blower assembly may require electrical resistance heating sources to heat an airflow exiting through the blower assembly in order to deliver the heated airflow to the air-conditioned space.

SUMMARY

In some embodiments of the disclosure, a blower housing is disclosed as comprising an inner surface configured as an ohmic heater.

In other embodiments of the disclosure, a HVAC system is disclosed as comprising an air handling unit comprising a blower assembly comprising an inner surface configured as an ohmic heater.

In yet other embodiments of the disclosure, method of heating an airflow in an HVAC system is disclosed as comprising: providing a blower assembly in an air handling unit of an HVAC system, wherein the blower assembly comprises a blower housing having an inner surface configured as an ohmic heater; passing an airflow through the air handling unit; and exchanging heat from the ohmic heater to the airflow.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

Figure 1:
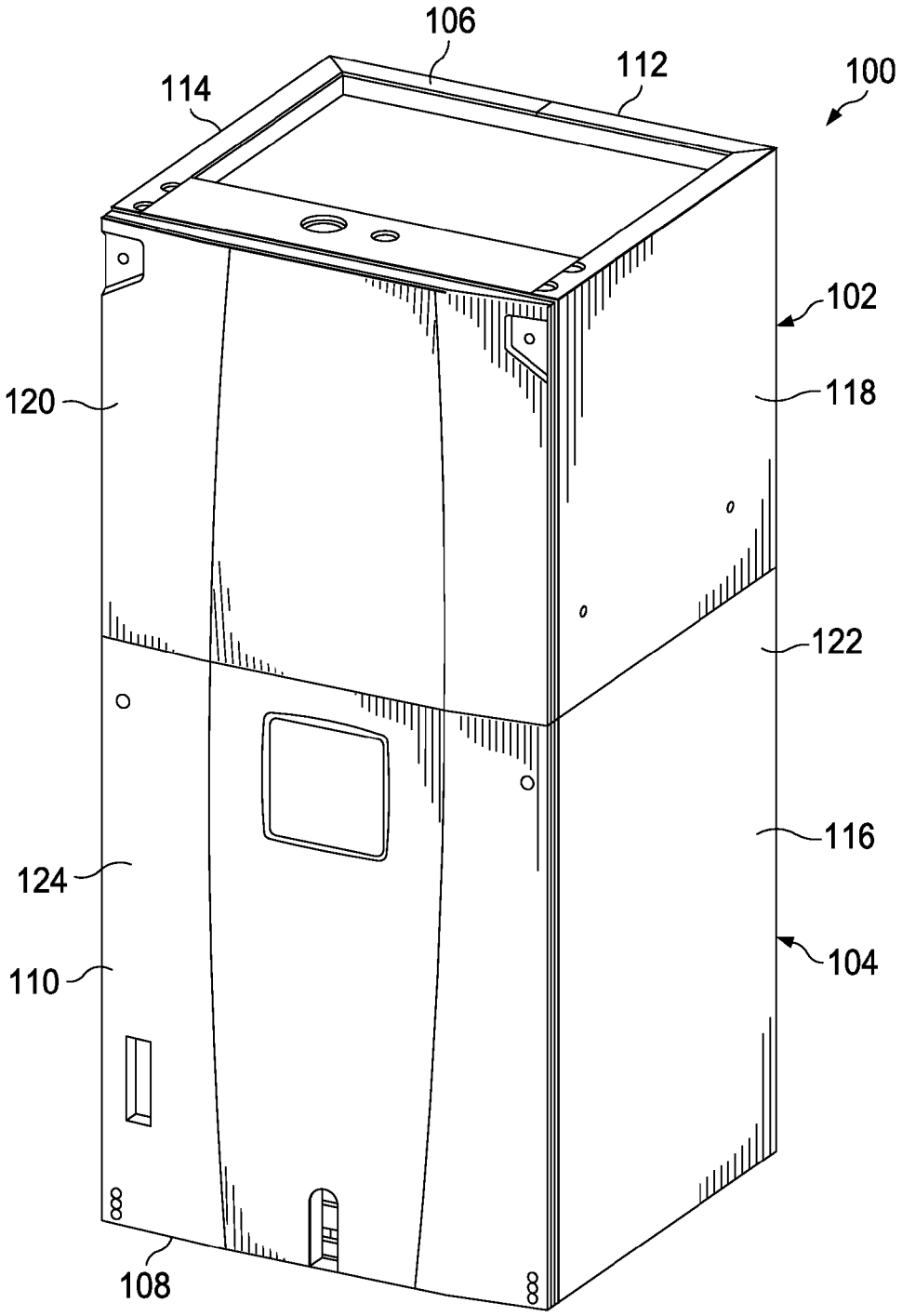
FIG. 1 is an oblique view of an air handling unit according to an embodiment of the disclosure.
Figure 2:
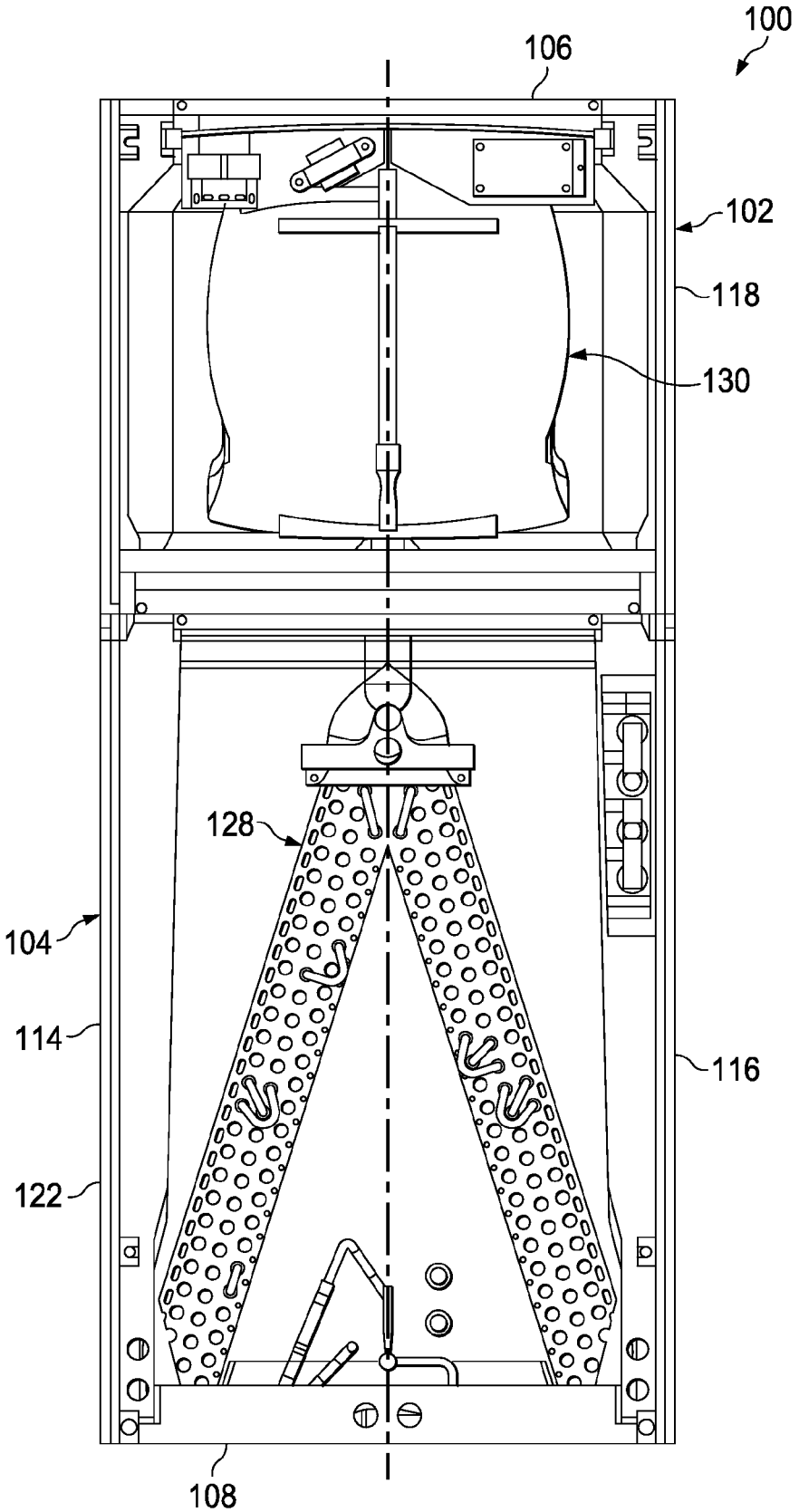
FIG. 2 is an orthogonal view of the front of the air handling unit of FIG. 1 according to an embodiment of the disclosure.

Referring now to FIG. 1-2, an oblique view, a front orthogonal view, and a partially exploded oblique view of an AHU 100 are shown, respectively, according to an embodiment of the disclosure. AHU 100 may generally be described as comprising a top side 106, a bottom side 108, a front side 110, a back side 112, a left side 114, and a right side 116. Such directional descriptions are meant to assist the reader in understanding the physical orientation of the various components parts of the AHU 100, but such directional descriptions shall not be interpreted as limitations to the possible installation orientations and/or configurations of the AHU 100. Additionally, the above-listed directional descriptions may be shown and/or labeled in the figures by attachment to various component parts of the AHU 100. Attachment of directional descriptions at different locations or two different components of AHU 100 shall not be interpreted as indicating absolute locations of directional limits of the AHU 100, but shall instead indicate that a plurality of shown and/or labeled directional descriptions in a single figure shall provide general directional orientation to the reader so that directionality may be easily followed amongst various figures. Furthermore, the component parts and/or assemblies of the AHU 100 may be described below as generally having top, bottom, front, back, left, and right sides which should be understood as being consistent in orientation with the top side 106, bottom side 108, front side 110, back side 112, left side 114, and right side 116 of the AHU 100.

AHU 100 generally comprises an upper blower section 102 attached to a lower heat exchanger section 104. The blower section 102 comprises a four-walled fluid duct that accepts fluid (air) through an open bottom side of the blower section 102 and allows exit of fluid through an open top side of the blower section 102. In some embodiments, the exterior of the blower section 102 may generally comprise a blower section outer skin 118 and a blower section panel 120. The blower section panel 120 is removable from the remainder of the blower section 102, thereby allowing access to an interior of the blower section 102. Similarly, the heat exchanger section 104 comprises a four-walled fluid duct that accepts fluid (air) from the air handler bottom 108 and passes the fluid from an open bottom side of the heat exchanger section 104 and allows exit of the fluid through an open top side of the heat exchanger section 104. The exterior of the heat exchanger section 104 generally comprises a heat exchanger section outer skin 122 and a heat exchanger section panel 124. The heat exchanger section panel 124 is removable from the remainder of the heat exchanger section 104, thereby allowing access to an interior of the heat exchanger section 104.

The AHU 100 further comprises a plurality of selectively removable components. A refrigeration coil assembly 128 that may be removable from and carried by the heat exchanger section 104. Similarly, the AHU 100 comprises a blower assembly 130 that may be removable from and carried by the blower section 102. The AHU 100 may be considered fully assembled when the blower assembly 130 is carried within the blower section 102, the refrigeration coil assembly 128 is carried within the heat exchanger section 104, and when the blower section panel 120 and heat exchanger section panel 124 are suitably associated with the blower section outer skin 118 and the heat exchanger section outer skin 122, respectively. When the AHU 100 is fully assembled, fluid (air) may generally follow a path through the AHU 100 along which the fluid enters through the bottom side 108 of the AHU 100, successively encounters the refrigeration coil assembly 128 and the blower assembly 130, and thereafter exits the AHU 100 through the top side 106 of the AHU 100. In some embodiments, the AHU 100 may generally be configured as a pull-through type AHU, where the blower 130 may generally be configured to pull air through the refrigeration coil assembly 128.

Figure 3:
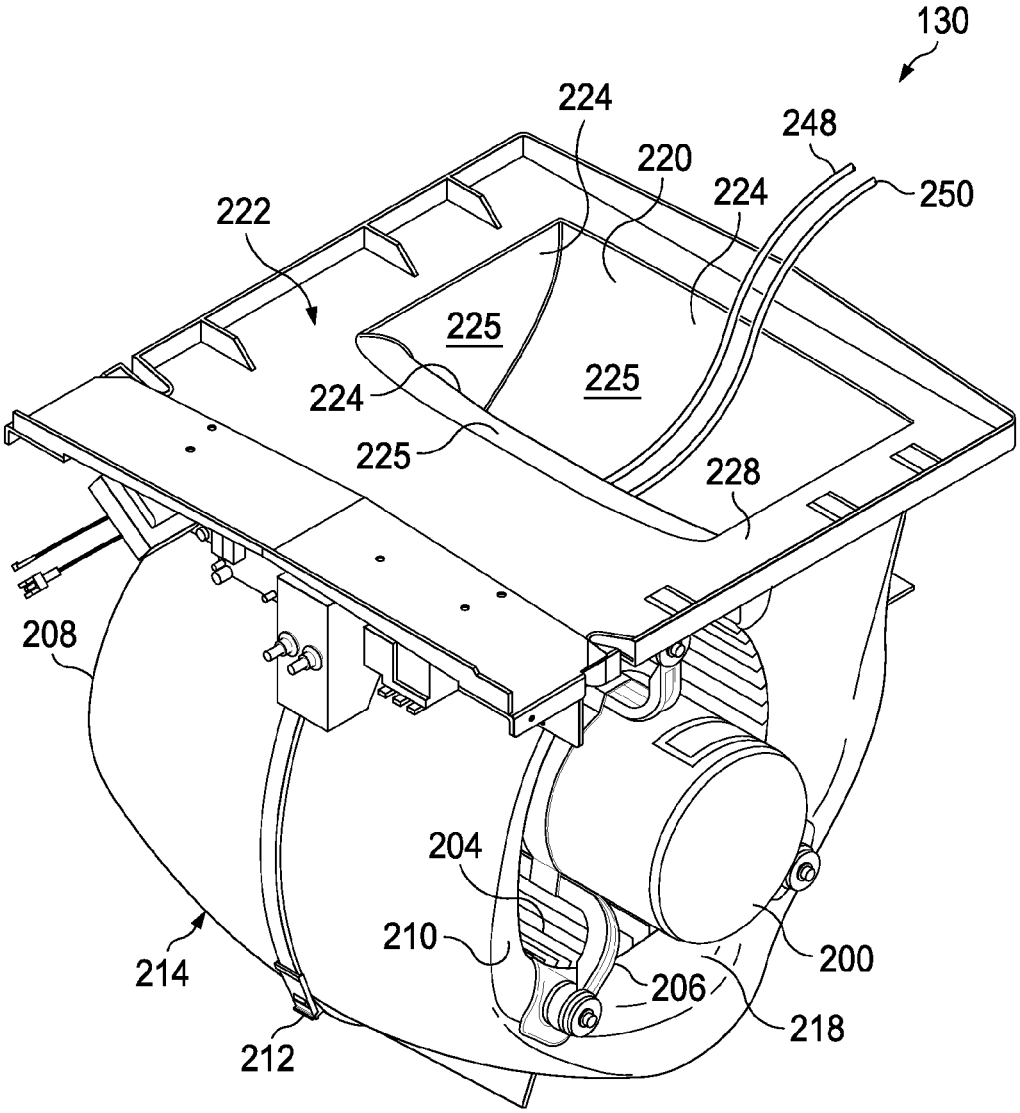
FIG. 3 is a front-upper-right oblique view of the blower assembly of FIG. 2 according to an embodiment of the disclosure.

Referring now to FIG. 3, an oblique view of the blower assembly 130 is shown from a front-upper-right viewpoint according to an embodiment of the disclosure. The blower assembly 130 generally comprises a motor 200 having a shaft 202 upon which an impeller 204 is mounted. The motor 200 is attached to a plurality of motor mounts 206 that holds the motor 200 in place relative to a left shell 208 of the blower assembly 130 and a right shell 210 of the blower assembly 130. In some embodiments, the left shell 208 and the right shell 210 may be selectively joined together via integral snap features as well as retaining clips 212 and/or any other suitable fastening means. The snap features and the retaining clips 212 may be operated to optionally disconnect the left shell 208 from the right shell 210. When joined, left shell 208 and the right shell 210 may be conceptualized as defining two distinct functional portions of the blower assembly 130 that generally form the blower housing 214.

A primary function of the blower housing 214 is to receive at least a portion of each of the motor 200 and the impeller 204 while also defining an intermediate air path that extends from each of the left air input port 216 of the blower assembly 130 and the right air input port 218 of the blower assembly 130, along inner surfaces 224 of the left shell 208 and the right shell 210, and exits through the blower output 220. It is the shape of the interior of the blower housing 214 in combination with the movement of the impeller 204 that allows the optional intake of air through the left air input port 216 and the right air input port 218 and subsequent output of that air through the blower output 220. Another functional portion of the blower assembly 130 may be referred to as the blower deck 222. A first primary function of the blower deck 222 is to serve as a physical component used in mounting the entire blower assembly 130 within and relative to the blower section 102. A second primary function of the blower deck 222 is to serve as a substantial air pressure barrier between the portion of the interior of the blower section 102 that houses the blower assembly 130 and the interior of the heat exchanger section 104.

In some embodiments, a portion of the blower assembly 130 may be configured as an ohmic heating device. As will be explained later in more detail, the inner surface 224 of the left shell 208 and/or the right shell 210 of the blower assembly 130 may comprise an electrically-conductive plating 225. Furthermore, in order to pass a current through the electrically-conductive plating 225 on the inner surface 224 of the left shell 208 and/or the right shell 210, the blower assembly 130 may comprise an outer electrode 248 and an inner electrode 250. In some embodiments, the outer electrode 248 may be attached to the electrically-conductive plating 225 along a larger diameter portion of a shell 208, 210, while the inner electrode 250 may be attached to the electrically-conductive plating 225 along a smaller diameter portion of a shell 208, 210. Furthermore, in some embodiments, where the ohmic heating provided by passing a current from one electrode 248, 250 to the other electrode 248, 250 through the electrically-conductive plating 225 on the inner surface provides sufficient heat to an airflow through the AHU 100, heater assembly 126 may not be required.

Figure 4:
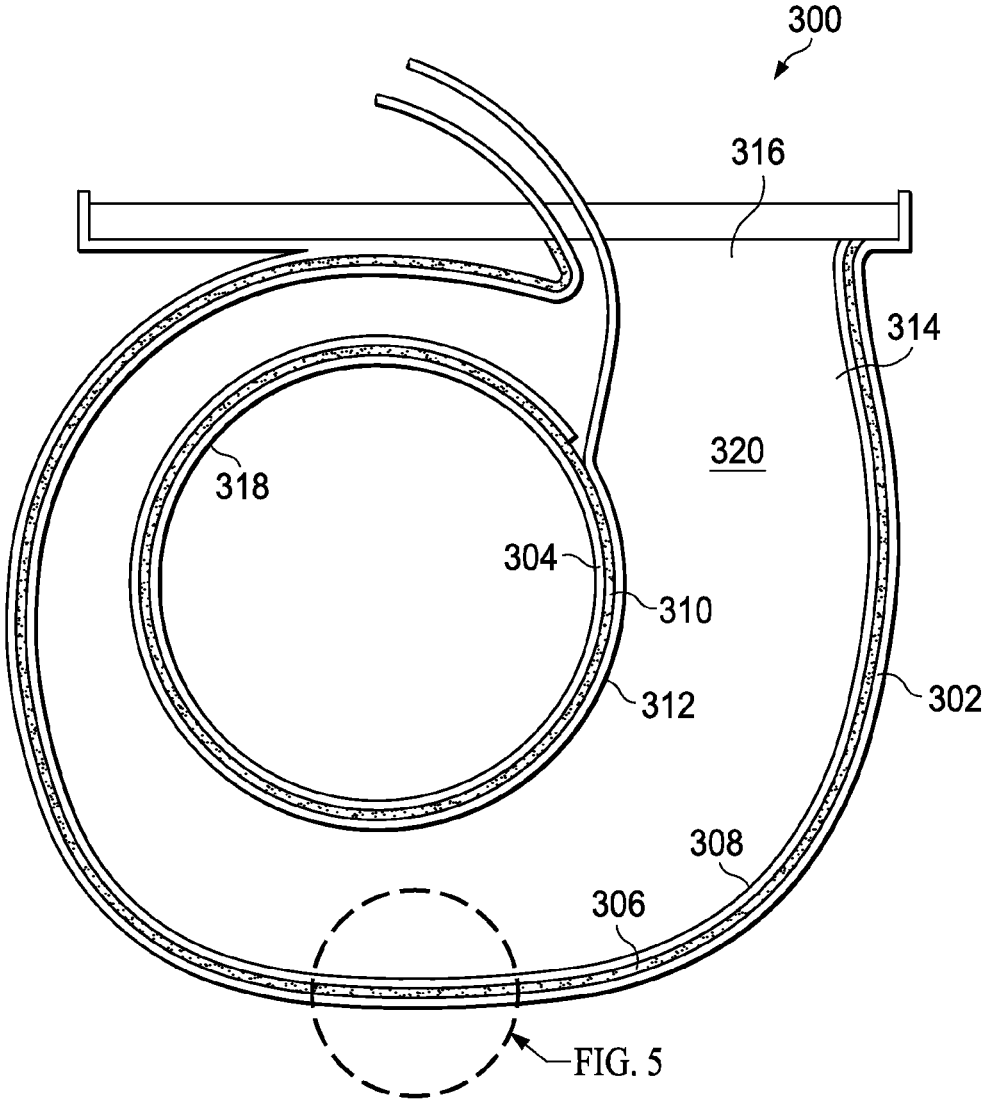
FIG. 4 is a cutaway side view of a blower housing comprising electrodes attached to an inner surface of the blower housing according to an embodiment of the disclosure.

Referring now to FIG. 4, a cutaway side view of a blower housing 300 comprising electrodes 308, 312 attached to an inner surface 314 of the blower housing 300 is shown according to an embodiment of the disclosure. Blower housing 300 may generally be substantially similar to blower housing 214 of FIG. 3 and may comprise a left shell and a right shell that is substantially similar to the left shell 208 and the right shell 210 of blower housing 214 of FIG. 3. Blower housing 300 may also comprise an outer wall 302 and an inner wall 304. In some embodiments, blower housing 300 may also comprise an inner surface 314 that may be substantially similar to inner surface 224 of FIG. 3 and that may generally extend from the outer wall 302 to the inner wall 304. Additionally, blower housing 300 may comprise a blower output 316 that may be substantially similar to blower output 220 of FIG. 3. In some embodiments, blower housing 300 may be a component of the blower assembly 130 shown in FIGS. 2-3.

Generally, the blower housing 300 may be formed from a thermosetting plastic. However, in some embodiments, blower housing 300 may be formed from a composite material and/or any other suitable material. The inner surface 314 of the blower housing 300 may generally comprise an electrically-conductive plating 320 applied thereto. In some embodiments, the electrically-conductive plating 320 applied to the inner surface 314 of the blower housing 300 may comprise stainless steel. In some embodiments, the electrically-conductive plating 320 may comprise aluminum, copper, titanium, and/or any other suitable electrically-conductive material that may adhere to the inner surface 314 of the blower housing 300. The electrically-conductive plating 320 may generally be applied to the inner surface 314 as a thin, film-like layer. In some embodiments, the electrically-conductive plating 320 of the inner surface 314 of the blower housing 300 may comprise a thickness of at least about 5 Angstroms, about 6 Angstroms, about 7 Angstroms, about 8 Angstroms, about 9 Angstroms, about 10 Angstroms, about 11 Angstroms, about 12 Angstroms, about 13 Angstroms, about 14 Angstroms, and about 15 Angstroms. It will be appreciated that the application of a thin electrically-conductive plating 320 may provide a resistance to electrical current that may generally cause the electrically-conductive plating 320 to heat up. Accordingly, in some embodiments, the thickness of the plating may be selected based on the amount of heat required.

Blower housing 300 may generally comprise an outer electrode 308 and an inner electrode 312. The electrodes 308, 312 may generally comprise a relatively low electrical resistance and may generally be configured to distribute an electrical current through the electrically-conductive plating 320 of the inner surface 314. In some embodiments, the electrodes 308, 312 may enter the blower housing 300 through the blower output 316. In other embodiments, however, the electrodes 308, 312 may enter the blower housing 300 through a hole in the outer wall 302 and/or any other suitable aperture in the blower housing 300 that allows the electrodes 308, 312 to be attached to the outer wall 302 and the inner wall 304, respectively. Generally, the electrodes 308, 312 may be flexible. Accordingly, in some embodiments, the outer electrode 308 may be attached peripherally to the inner surface 314 of the blower housing 300 at the outer wall 302 and may substantially conform to a contour of the outer wall 302, while the inner electrode may be attached to the inner surface 314 of the blower housing 300 at the inner wall 312 and may substantially conform to a contour of the inner wall 304. In some embodiments, the outer electrode 308 may be attached to the inner surface 314 at the outer wall 302 so that a substantial portion of outer electrode 308 attached to the inner surface 314 may be in electrical connection with the inner surface 314 of the blower housing 300. Additionally, in some embodiments, the inner electrode 312 may be attached to the inner surface 314 at the inner wall 304 so that a substantial portion of inner electrode 312 attached to the inner surface 314 may be in electrical connection with the inner surface 314 of the blower housing 300. In some embodiments, substantially the entire portion of the electrodes 308, 312 attached to the inner surface 314 may be in substantial electrical connection with inner surface 314 of the blower housing 300.

Most generally, the outer electrode 308 may be attached to the inner surface 314 at the outer wall 302 by an outer adhesive layer 306, while the inner electrode 312 may be attached to the inner surface 314 at the inner wall 304 by an inner adhesive layer 310. The adhesive layers 306, 310 may generally comprise an electrically-conductive adhesive configured to adhere to a majority of metallic materials and/or typical substrates, including, but not limited to, the thin, electrically-conductive plating 320 of the inner surface 314 of the blower housing 300. In some embodiments, the adhesive layers 306, 310 may comprise an electrically-conductive silicone that is a room-temperature vulcanizing (RTV) silicone. In some embodiments, the adhesive layers 306, 310 may comprise RTV silicone that is impregnated with graphite and/or nickel which may provide the electrical-conductive properties to the RTV silicone.

Because the electrodes 308, 312 may generally conform to the contour of the inner surface 314 and/or the electrically-conductive plating 320 at the outer wall 302 and inner wall 304, respectively, the adhesive layers 306, 310 may be configured to remain pliable, even after curing. In some embodiments, the adhesive layers 306, 310 may also be configured to withstand high thermal stresses due to the current passing through the layers 306, 310. Additionally, in some embodiments, attaching the electrodes 308, 312 to the electrically-conductive plating 320 of the inner surface 314 via the adhesive layers 306, 310 as opposed to directly attaching the electrodes 306, 310 to the electrically-conductive plating 320 of the inner surface 314 may prevent the electrodes 308, 312 from shearing the electrically-conductive plating 320 of the inner surface 314 due to excessive strain from the thermal expansion differential between the hot conductive plating 320 and the relatively cool electrodes 308,312. In operation, and most generally, the blower housing 300 may be configured so that a current may flow from the so-called "hot" electrode through the electrically-conductive plating 320 of the inner surface 314 to the so-called "ground" electrode. In some embodiments, the inner electrode 312 may comprise the so-called "hot" electrode, while the outer electrode 308 may comprise the so-called "ground" electrode. In such embodiments, the current may generally flow from the inner electrode 312 through the electrically-conductive plating 320 of the inner surface 314 to the outer electrode 308. In alternative embodiments, however, the outer electrode 308 may comprise the so-called "hot" electrode, while the inner electrode 312 may comprise the so-called "ground" electrode. In such alternative embodiments, the current may generally flow from the outer electrode 308 through the electrically-conductive plating 320 of the inner surface 314 to the inner electrode 312. As current is passed through the electrically-conductive plating 320 of the inner surface 314, the current may cause the electrically-conductive plating 320 of the inner surface 314 to heat up. The heating up of the electrically-conductive plating 320 of the inner surface 314 may generally be referred to as ohmic heating.

The outer electrode 308 and the inner electrode 312 may generally be configured such that a substantial portion of each of the outer electrode 308 and the inner electrode 312 attached to the inner surface 314 may be in electrical connection with the electrically-conductive plating 320 of the inner surface 314. In some embodiments, substantially all of the outer electrode 308 and the inner electrode 312 attached to the inner surface 314 via the outer adhesive layer 306 and the inner adhesive layer 310, respectively, may be in electrical connection with the electrically-conductive plating 320 of the inner surface 314. Attaching the electrodes 308, 312 substantially all the way around the walls 302, 304, respectively, may generally distribute the current passing from one of the electrodes 308, 312, through the electrically-conductive plating 320, and to the other electrode 308, 312, throughout the electrically-conductive plating 320 of the inner surface 314 of the blower housing 300. In some embodiments, distributing the current throughout the electrically-conductive plating 320 of the inner surface 314 by attaching the electrodes 308, 312 to the inner surface 314 substantially all the way around the outer wall 302 and inner wall 304, respectively, may produce a substantially isothermal temperature across the electrically-conductive plating 320 of the inner surface 314. Additionally, in some embodiments, distributing the current throughout the electrically-conductive plating 320 of the inner surface 314 by attaching the electrodes 308, 312 to the inner surface 314 substantially all the way around the outer wall 302 and inner wall 304, respectively, may also prevent current from concentrating at a single electrical connection point to the inner surface 314, which may produce excessive local temperatures near the connections and cause damage and/or failure of the respective electrical connections to the electrically-conductive plating 320.

Because blower housing 300 may be substantially similar to blower housing 214 in FIG. 3, blower housing 300 may substantially similarly define an intermediate air path that extends from an input port 318 that may be substantially similar to left air input port 216 and/or right air input port 218 of blower assembly 224, along inner surface 314, and exits the blower output 316. As an airflow is passed through the intermediate air path of the blower housing 300, the electrically-conductive plating 320 of the inner surface 314 may transfer at least a portion of the heat generated through ohmic heating by the current passing through the electrically-conductive plating 320 of the inner surface 314 to the airflow. In some embodiments, an ambient airflow entering the blower housing 300 may cool a motor of a blower, such as motor 200 of blower 130 in FIG. 3, while the blower housing 300 may be configured to heat the airflow to provide electric heat downstream of the blower 130 shown in FIGS. 2-3.

Most generally, the current flow through the electrically-conductive plating 320 of the inner surface 314 may cause the electrically-conductive plating 320 to heat up in accordance with the equation $P=I^2R$, where P is the power measured in Watts, I is the current measured in Amperes, and R is the resistance measured in Ohms. Alternatively, the current flow through the electrically-conductive plating 320 of the inner surface 314 may cause the electrically-conductive plating 320 to heat up in accordance with the equation $P=V^2/R$, where P is the power measured in Watts, V is the voltage measured in Volts, and R is the resistance measured in Ohms. For example, in some embodiments, supplying a voltage of about 230 V and a current of about 40 Amperes may result in about 9.2 kW of heat produced by the blower housing 300 at 5.75 Ohms of resistance.

Figure 5:
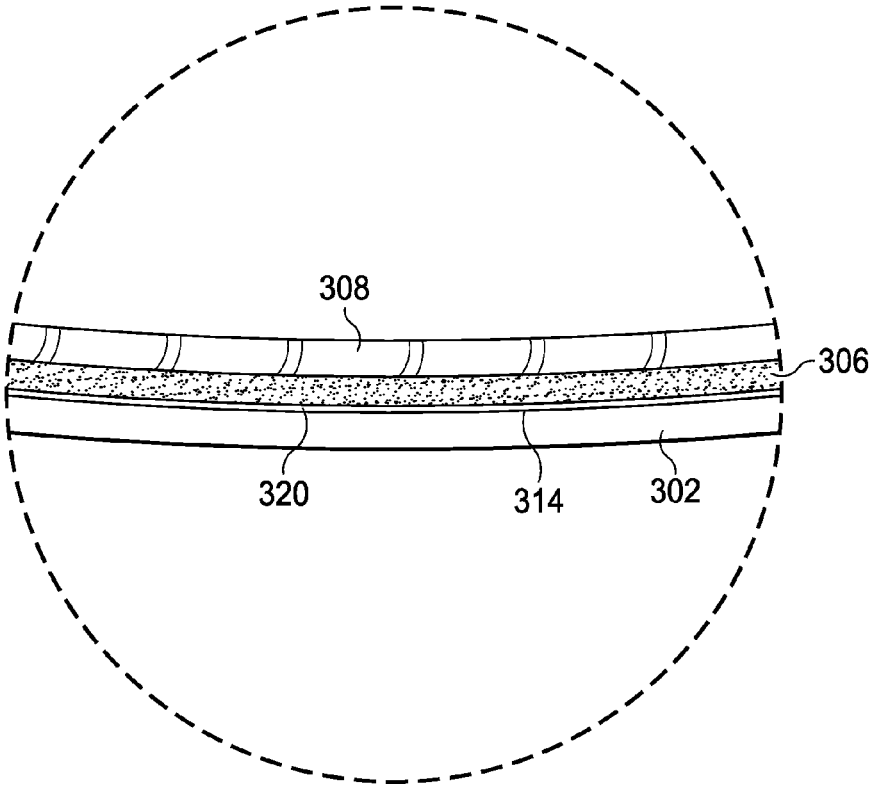
FIG. 5 is a detailed view the cutaway side view of the blower housing of FIG. 5 comprising an electrically-conductive plating according to an embodiment of the disclosure.

Referring now to FIG. 5, a detailed view of the cutaway side view of the blower housing 300 of FIG. 4 comprising an electrically-conductive plating 320 is shown according to an embodiment of the disclosure. As shown, the outer wall 302 comprises an inner surface 314 that is plated with a thin, electrically-conductive plating 320. Additionally, the outer electrode 308 may generally be attached to and substantially electrically connected along the outer wall 302 to the electrically-conductive plating 320 of the inner surface 314 via the outer adhesive layer 306. Additionally, the outer electrode 308 may conform to the profile of the outer wall 302, the electrically-conductive plating 320, and/or the outer adhesive layer 306. It will be appreciated that while the outer wall 302, outer adhesive layer 306, and outer electrode 308 are shown in Detail A, the inner wall 304, inner adhesive layer 310, and inner electrode 312 may configured in substantially the same manner, respectively.

Figure 6:
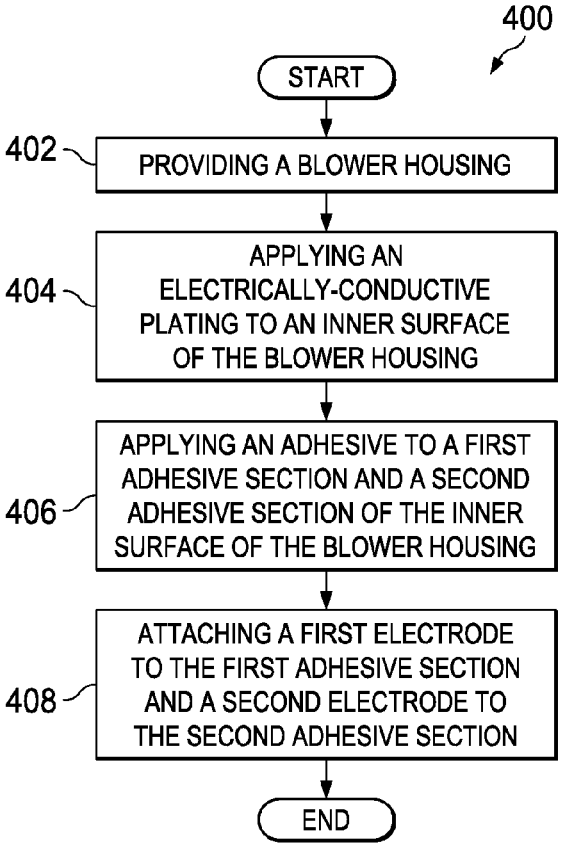
FIG. 6 is a flowchart of a method of constructing an ohmic heater is shown according to an embodiment of the disclosure.

Referring now to FIG. 6, a flowchart of a method 400 of constructing an ohmic heater is shown according to an embodiment of the disclosure. The method 400 may begin at block 402 by providing a blower housing 300. The method 400 may continue at block 404 by applying a thin, electrically-conductive plating to an inner surface of the blower housing. In some embodiments, the thickness of the electrically-conductive plating may be selected as a function of the heat required to be supplied. In some embodiments, the electrically-conductive plating may comprise stainless steel. The method 400 may continue at block 406 by applying an adhesive to a first adhesive section and a second adhesive section of the inner surface of the blower housing. In some embodiments, the adhesive may comprise electrically-conductive RTV silicone. In some embodiments, the first adhesive section may comprise an inner surface at the inner wall of the blower housing, and the second adhesive section may comprise an inner surface at the outer wall of the blower housing. The method 400 may conclude at block 408 by attaching a first electrode to the first adhesive section and a second electrode to the second adhesive section.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A blower housing, comprising:

an inner surface comprising an electrically-conductive plating and configured as an ohmic heater, wherein the ohmic heater comprises a first electrode disposed around and electrically coupled to an inner surface wall of the blower housing that comprises a first diameter and a second electrode disposed around and electrically coupled to a second inner surface wall of the blower housing that comprises a second diameter that is different than the first diameter.

2. The blower housing of claim 1, wherein the blower housing is formed from a thermosetting plastic.

3. The blower housing of claim 1, wherein the electrically-conductive plating comprises at least one of a stainless steel plating, an aluminum plating, a copper plating, and a titanium plating.

4. The blower housing of claim 1, wherein the ohmic heater is configured to produce a substantially isothermal temperature across the electrically-conductive plating.

5. The blower housing of claim 1, wherein the first electrode and the second electrode are attached to the inner surface via an adhesive.

6. The blower housing of claim 5, wherein the adhesive is an electrically-conductive silicone.

7. The blower housing of claim 1, wherein the ohmic heater second electrode is configured to pass current through the inner surface to the first eectrode.

8. The blower housing of claim 1, wherein the first electrode is configured to pass current through the inner surface to the second electrode.

9. A heating, ventilation, and/or air conditioning (HV AC) system, comprising:

an air handling unit comprising a blower assembly comprising:

an inner surface configured as an ohmic heater, wherein the ohmic heater comprises a first electrode disposed around an inner surface wall of the blower housing that comprises a first diameter, and a second electrode disposed around a second inner surface wall of the blower housing that comprises a second diameter different than the first diameter.

10. The HV AC system of claim 9, wherein the inner surface comprises an electrically-conductive plating.

11. The HV AC system of claim 10, wherein the inner surface comprises at least one of a stainless steel plating, an aluminum plating, a copper plating, and a titanium plating.

12. The HV AC system of claim 9, wherein the ohmic heater is configured to produce a substantially isothermal temperature across the inner surface.

13. The HV AC system of claim 9, wherein the first electrode and the second electrode are attached to the inner surface via an adhesive.

14. The HV AC system of claim 13, wherein the adhesive is an electrically-conductive silicone.

15. The HV AC system of claim 11, wherein the ohmic heater is configured to heat the electrically-conductive plating of the inner surface of the blower housing by passing an electrical current from at least one of (1) the first electrode through the electrically-conductive plating to the second electrode and (2) the second electrode through the electrically-conductive plating to the first electrode.

16. A method of heating an airflow in a heating, ventilation, and/or air conditioning (HVAC) system, comprising:

providing a blower assembly comprising a blower housing comprising an inner surface;

configuring the inner surface as an ohmic heater by (1) applying an electrically-conductive plating to an inner surface of the blower housing and (2) electrically coupling a first electrode to an inner wall of the inner surface of the blower housing and a second electrode to an outer wall of the inner surface of the blower housing;

heating the electrically-conductive plating of the inner surface of the blower housing by passing an electrical current from at least one of (1) the first electrode through the electrically-conductive plating to the second electrode and (2) the second electrode through the electrically-conductive plating to the first electrode;

passing an airflow through the blower housing and at least partially into contact with the electrically-conductive plating of the inner surface of the blower housing; and transferring heat from the electrically-conductive plating of the inner surface of the blower housing to the airflow.

17. The method of claim 16, wherein the passing an airflow through the blower housing is accomplished by operating a blower motor of the blower assembly.

18. The method of claim 17, wherein the blower assembly is installed in an air handling unit of the HVAC system.

19. The method of claim 16, further comprising: producing a substantially isothermal temperature across the electrically-conductive plating of the inner surface of the blower housing.

* * * * *